US005520285A

United States Patent [19]

Mursch et al.

[11] Patent Number: 5,520,285

[45] Date of Patent: May 28, 1996

[54] FOLDABLE PACKAGE FOR GOODS

[76] Inventors: Michael Mursch; Peter Knopp, both of Schloss Euernbach, D-85298 Scheyern, Germany

[21] Appl. No.: 293,713

[22] Filed: Aug. 22, 1994

[51] Int. Cl.[6] ..... B65D 85/00; B65D 81/36

[52] U.S. Cl. ..... 206/526; 206/373; 206/378; 206/379; 206/45.24; 206/733; 206/749

[58] Field of Search ..... 206/373–380, 206/45.11, 44.12, 45.13, 45.15, 45.24, 526

[56] References Cited

U.S. PATENT DOCUMENTS

| | | | |
|---|---|---|---|
| 953,930 | 4/1910 | Stockinger | 206/379 |
| 2,545,611 | 3/1951 | Flannery | 206/380 |
| 2,589,593 | 3/1952 | Anderson et al. | 206/45.13 |
| 2,592,678 | 4/1952 | Fuerst | 206/45.11 |
| 3,154,192 | 10/1964 | Cowley | 206/379 |
| 3,236,366 | 2/1966 | Broda et al. | 206/379 |
| 3,335,847 | 8/1967 | Murphy et al. | 206/380 |
| 3,978,984 | 9/1976 | Cowley | 206/379 |
| 4,210,244 | 7/1980 | Westrick | 206/373 |
| 4,314,635 | 2/1982 | Fraser et al. | 206/232 |
| 4,619,364 | 10/1986 | Czopor, Jr. | 206/379 |
| 5,248,030 | 9/1993 | Tarozzi | 206/379 |

FOREIGN PATENT DOCUMENTS

| | | | |
|---|---|---|---|
| 3627137 | 2/1988 | Germany | 206/373 |
| 3641965 | 6/1988 | Germany . | |
| 9015549 | 3/1991 | Germany . | |
| 9318300 | 4/1994 | Germany . | |
| 172533 | 1/1935 | Switzerland | 206/45.11 |

*Primary Examiner*—Jimmy G. Foster
*Assistant Examiner*—Marie Patterson
*Attorney, Agent, or Firm*—Hughes, Multer & Schacht

[57] ABSTRACT

A package for small parts having a first shipping and/or storage position, a second display position, and a third service position. The package has an areal support which is divided into four section by a transversely extending hinge connection and a longitudinally extending hinge connection. In the first position, the right and left portions of the package are folded over on one another to form a package enclosing the parts. In the second position the areal support is laid open in substantially the same plane where the parts are visible but cannot readily be removed from the package. In the third position, the package is folded back on itself along the longitudinal axis to provide access to the parts.

22 Claims, 5 Drawing Sheets

FOLDABLE PACKAGE FOR GOODS

Figure 3:
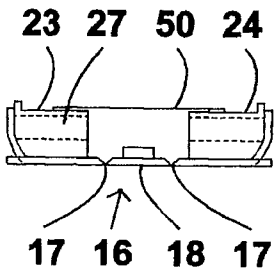

The invention relates to a package for goods with an areal support with a front and a back and with receptacles for the goods on the front of the support.

Such packages are used as sales packages for drills, milling cutters, tool attachments, bits and similar small parts.

Generally known are sales packs which are designed as multipart boxes and have transparent covers through which the small parts to be sold are to be recognized. Because of the light reflexes produced by them, the transparent covers distract when the goods are on display and also mean additional packaging refuse. The transparent covers are necessary, however, in order to prevent an accidental spillage or an intentional removal. In order to keep the small parts readily accessible for use, a movable flap section which automatically raises itself when the package is opened is often additionally used in such packages to house the small parts.

Packages are also known in which the small parts are stored pointing upwards at a slight angle, as a result of which the small parts are readily graspable after the opening of the cover. However, the package becomes substantially larger as a result.

In order to prevent small parts from falling out, open packages or holding systems in film—sometimes on an additional cardboard support—are welded in. This is so-called blister packaging. A general disadvantage of blister packaging is that the package is made from at least two different materials.

The object of the invention is to provide a package which stores small parts securely on the one hand and on the other hand makes possible a small removal of the small parts for use.

According to the invention, this object is achieved in that the support is divided by a first fold axis into two sections and is foldable together around the first fold axis in such a way that the two sections face each other with their fronts, and in that the support has a second fold axis which runs at a right angle to the first fold axis and the two sections are each divided into two sub-sections, the support being foldable around the second fold axis in such a way that the backs of the sub-sections face each other.

The development of the package according to the invention makes possible three forms of use of the package:

In the first form of use, the areal support is folded together around neither of the two fold axes, with the result that it is just spread out. In this form of use, the package according to the invention can be used e.g. as a sales pack, as all the receptacles for the small parts are then readily visible on the front of the support, with the result that all the small parts contained in the receptacles are readily recognizable at a glance.

In the second form of use, the areal support of the package according to the invention is folded together around the first fold axis, with the result that the receptacles of the first section of the support lie against the receptacles of the second section and are thus in the inside of the package, whereas only the smooth back of the support is visible to the observer. In this form of use, the package according to the invention is a sealed storage container for the small parts. When this storage container is opened, the receptacles are then in the lower part and in the inside of the upper part of the container, the lower part being formed by one section of the support and the upper part of the cover by the other section of the support.

In the third form of use, the areal support is folded around the second fold axis, with the result that the backs of the sub-sections are directed against each other. With this form of use, the package is in the service position. In it, all the receptacles point in the same direction, namely with their longitudinal axis upwards, with the result that the small parts can be readily grasped and removed from the package.

Because the package according to the invention can be brought in each case into the form of use or configuration suitable for the transportation, sales display and use of the small parts contained in it, there are no special transportation and sales packages, or disposal or recycling costs associated with them.

The package according to the invention is preferably made from plastic, e.g. polypropylene, injection moulded and in one piece, with the fold axes being designed as film hinges, with the result that production can take place in one operation and fully automatically.

The first fold axis is preferably realized by two parallel film hinges, the distance between which is equal to the height of the package in the second form of use, i.e. to the height of the closed package during transportation or storage.

In a particularly preferred development of the invention, the receptacles are designed as pockets which are arranged in two rows at the edge of every section of the areal support in such a way that the insertion openings of the pockets of one row face the insertion openings of the pockets of the row lying opposite. The distance between the insertion openings of opposite pockets and the depth of these pockets can be matched to the dimensions of the small parts for which the package is intended in such a way that only a minimal distance is left between the small parts contained in pockets facing each other, i.e. the tips of the small parts virtually touch each other. In the first form of use (sales form), the small parts then block each other mutually, with the result that they cannot be removed from the pockets. Individuals small parts can therefore no longer be stolen from a package displayed in a self-service business. The business packs frequently used for this purpose are therefore not necessary with the package according to the invention. In addition, it is advisable to block the second fold axis, in order to prevent anyone from folding down the sub-sections with the rows of receiving pockets and then removed the small parts. Such a blockage can be simply achieved by a security strip which connects two opposite pockets and is glued or welded on the top of the pockets.

To improve the rigidity of the package in the third form of use (service form), the second fold axis is preferably realized by two film hinges running parallel at a distance. The distance between the two film hinges can e.g. lie in the range from a sixth to a third of the width of the areal support, with the result that the sub-sections stand parallel to each other at this distance in the service position and form a correspondingly broad base for the placement of the package e.g. on a worktable. By means of tabs at the the lateral ends of the sub-sections, the folded-over sub-sections can be fixed in this position, the rigidity of the package in the service position being further improved substantially by the tabs.

Although the first and second fold axes are normally each realized by two parallel film hinges, it may be advisable from time to time to rotate one film hinge by a certain angle in one direction and the other film hinge by the same angle in the opposite direction, with the result that the film hinges diverge. In the closed state (storage), the package is then conical. This can be advantageous if small parts with very different diameters are to be stored and displayed in the package.

There is also the possibility of producing the pockets or receptacles lying next to one another at the longitudinal edge of a section as a separate part, whereby the dimensions of the pockets or receptacles can be matched to different sets of small parts. The small areal support, fitted with different pocket elements, is then used for different sets of small parts. The pocket elements can be glued fast on the areal support or secured by snap or stop elements.

Figure 2:
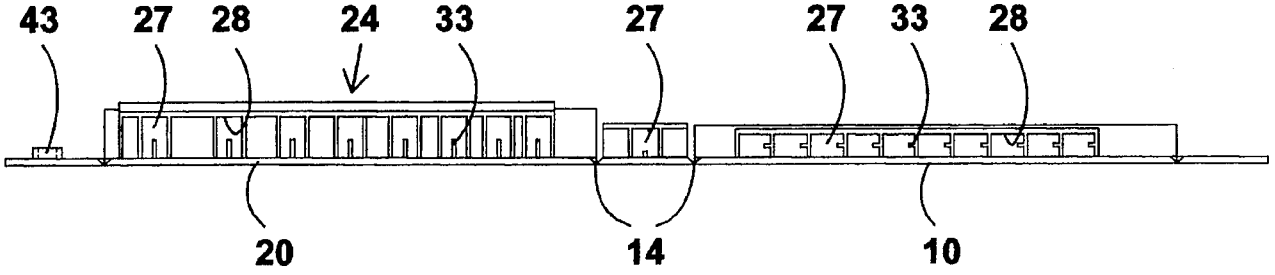
Figure 1:
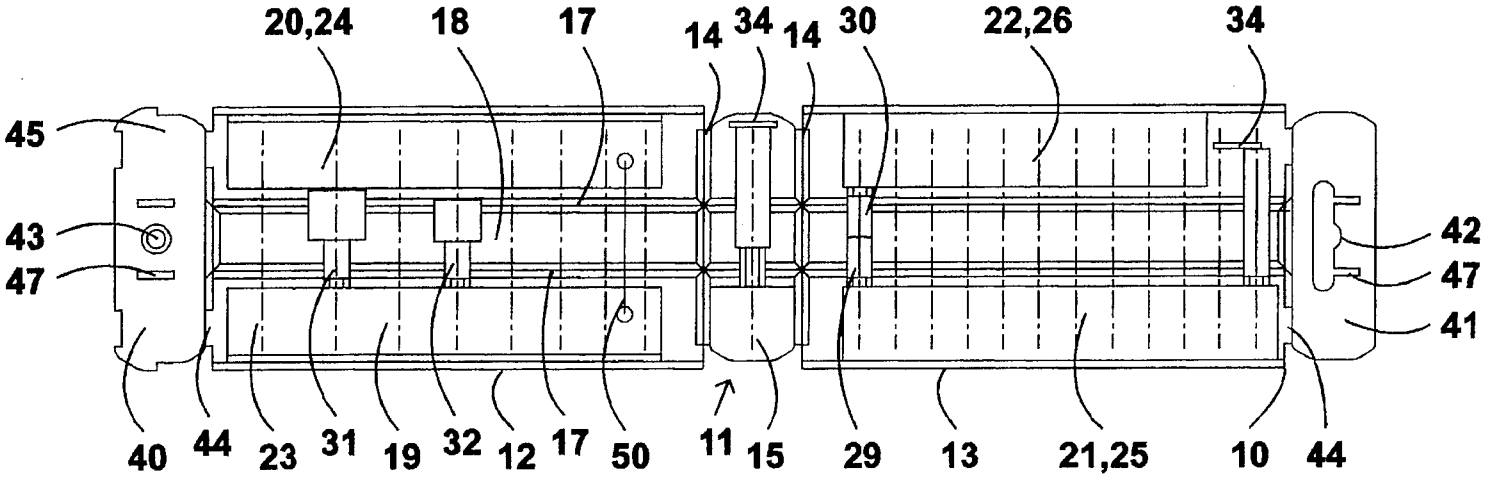
Figure 5:
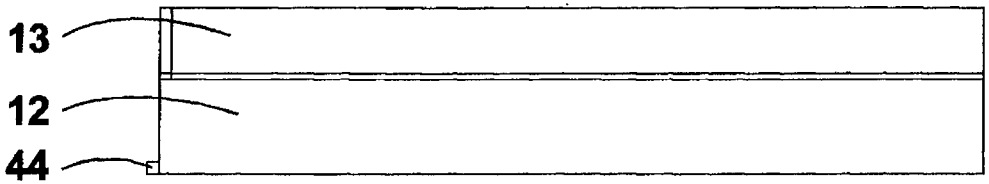
Figure 4:
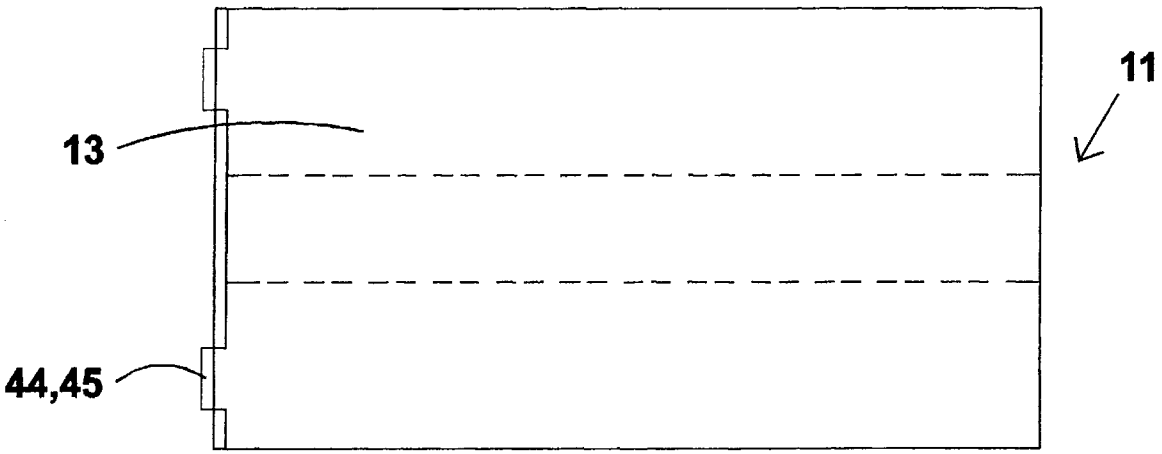
Figure 6:
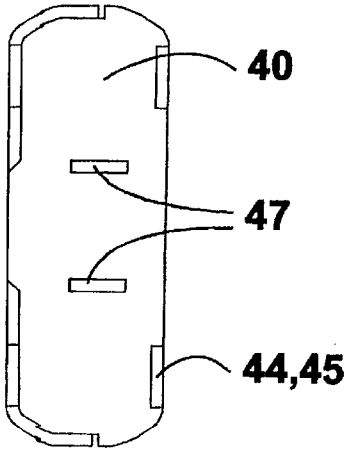
Figure 8:
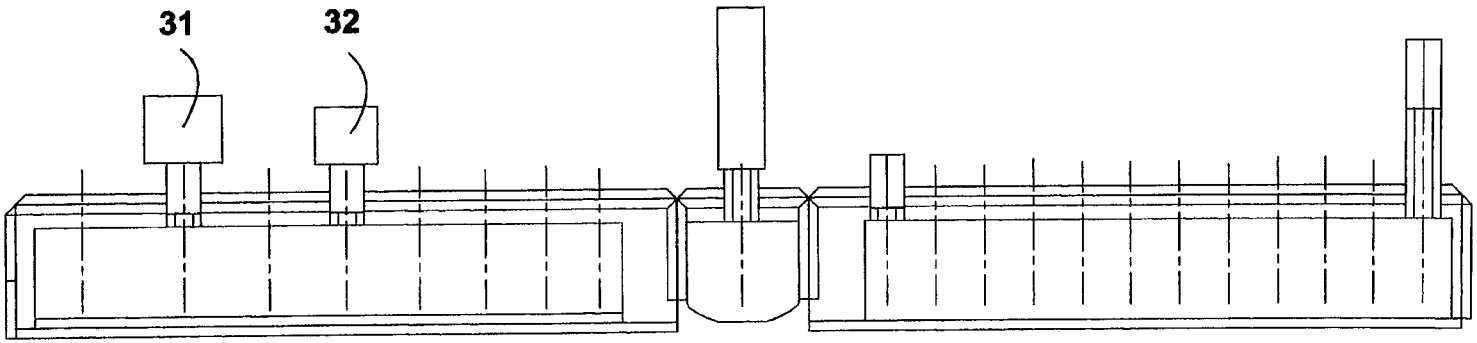
Figure 7:
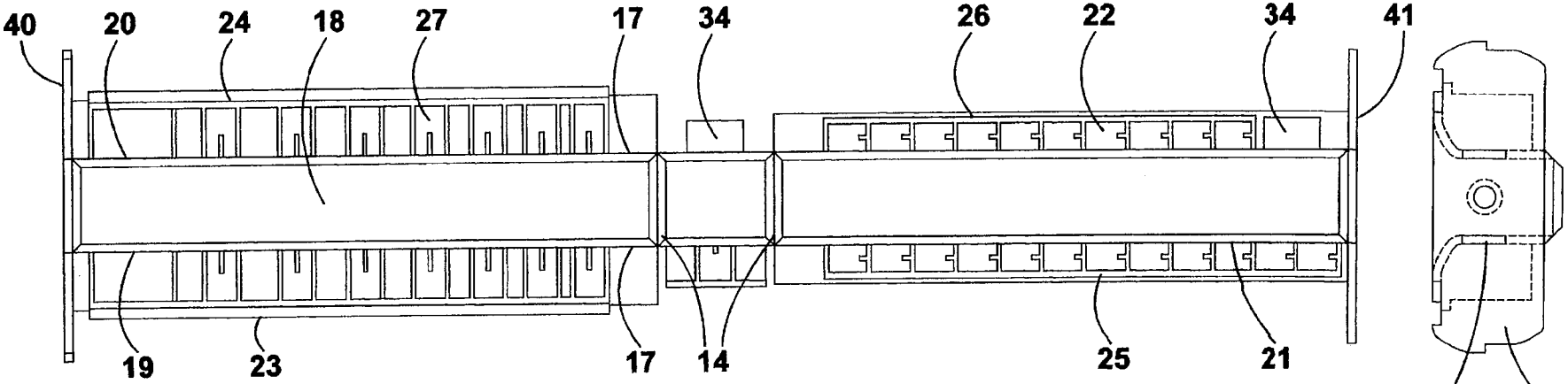
Figure 9:
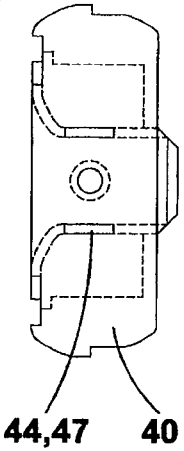
Figure 10:
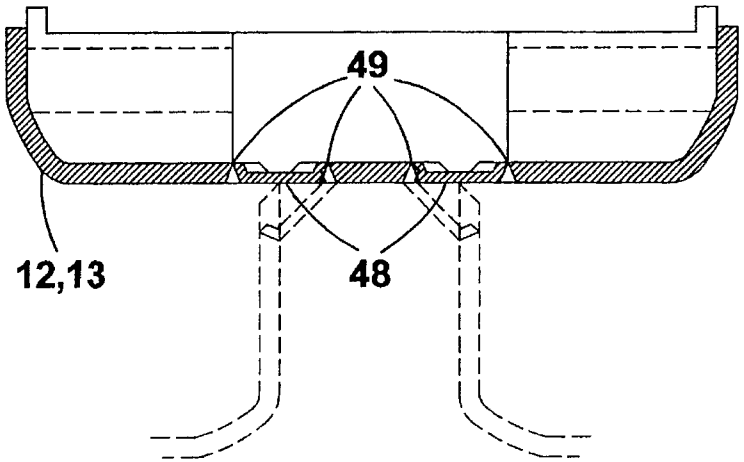
Figure 11:
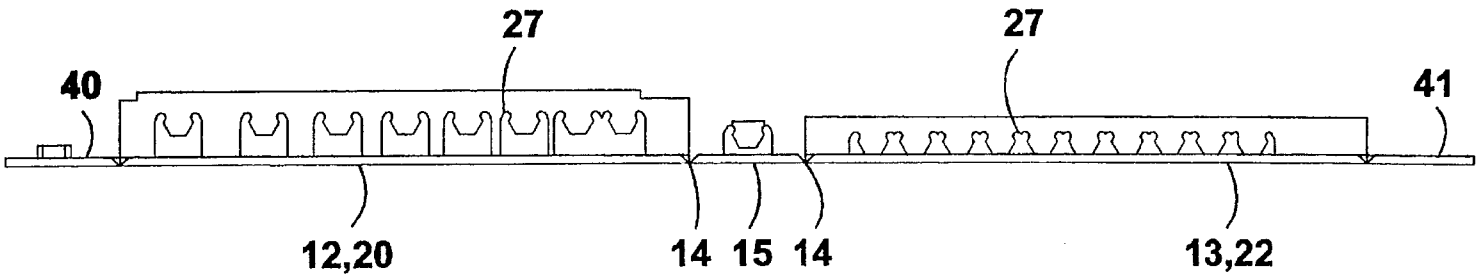
Figure 12:
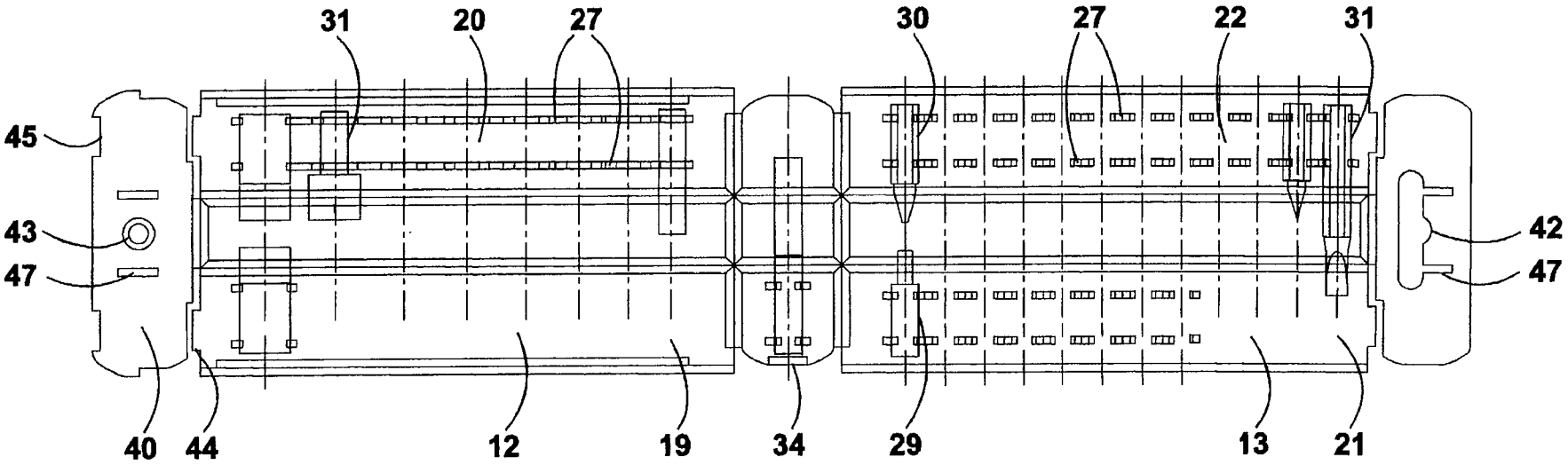

An embodiment of the invention is explained below with reference to the drawing. Shown are:

FIGS. 1, 2 and 3 the sales or display form of the package in plan view, in section and in front view respectively;

FIGS. 4, 5 and 6 the transportation or storage form of the package in plan view, side view and front view respectively;

FIGS. 7, 8 and 9 the service form of the package in plain view, side view and front view respectively;

FIG. 10 a representation similar to that of FIG. 3, the sub-sections being held in the folded-over position by moulded-in plastics springs and FIG. 11 a view similar to that of FIG. 2 of a version with open receptacles for the small parts;

FIG. 12 a plan view similar to that of FIG. 1 of a version with open receptacles or clips for retaining parts.

According to FIGS. 1, 2 and 3 the package has an areal support 10 which is divided into two sections 12 and 13 by a first fold axis 11. The first fold axis 11 comprises two film hinges 14 running parallel to each other at a distance and a narrow part 15 lying between them of the support 10. The two sections 12 and 13 have the same dimensions in the plan view of FIG. 1, with the result that they come to cover each other if the support 10 is folded together around the fold axis 11, i.e. around the two film hinges 14.

Running at right angles to the first fold axis 11 is a second fold axis 16 which again is realized by two film hinges 17 which run parallel to each other at a distance and are separated by a narrow strip 18 of the support 10. The width of the strip 18 is roughly a quarter of the overall width of the areal support 10. The two film hinges 17 run at right angles to the two film hinges 14. The second fold axis 16 divides the two sections 12 and 13 each into two sub-sections 19 and 20 and 21 and 22 respectively. Rows 23 to 26 of receptacles 27 are provided along the four sub-sections 19, 20, 21 and 22. The receptacles 27 are cavities which have a reception opening 28 at only one end. Inserted into the receptacles 27 are e.g. the shafts of tool attachments. The reception openings 28 of the two rows 23 and 24 and 25 and 26 respectively of receptacles 27 on a section 12 or 13 face each other, with the result that the tips or heads of the small parts contained in the receptacles 27 almost touch each other, as is illustrated in FIG. 1 by means of the small parts 29 and 30. In the form of use of the package as a sales or display pack, shown in FIG. 1, the small parts 29, 30 cannot be removed. Larger small parts such as the plug-in nuts 31 and 32 likewise shown in FIG. 1 are so dimensioned in their shaft length that they extend as far as the opposite row 24 of receptacles 27 and therefore can likewise not be removed in the form of use of the package of FIG. 1.

FIG. 2 shows the package of FIG. 1 in section, looking onto the receptacle openings 28. The elastic holding ribs 33, provided in the receptacles 27, which run in longitudinal direction of the receptacles 27 and project towards the middle, are recognized. In the case of the receptacles 27 of section 13, the holding ribs 33 are provided at a partition of two receptacles 27, as these receptacles are provided for particularly small parts e.g. screwdriver bits. In the case of the receptacles 27 of section 12, on the other hand, the holding ribs 33 project perpendicularly upwards from the support 10, with the result that the shaft axis of the accommodated small part, e.g. of the plug-in nuts 31, 32, is at a certain minimum distance from the top of the support 10, with the result that these receptacles 27 are also suitable for accommodating small parts with a larger diameter. A receptacle 27 for special small parts, e.g. small parts of greater length, such as a magnet holder for screwdriver bits, can be located on the intermediate part 15 between the two film hinges 14. To prevent the magnet holder from falling out or being removed in the form of use of the package of FIG. 1, a rib 34 is provided here at a distance from the receptacle 27 which corresponds to the length of the small part. To create an accommodation possibility for small parts of greater length, some of the receptacles 27 can also be omitted in a row 23 to 26, with the result that a small part of greater length can be fitted in the opposite receptacle. Here, too, a rib 34 is again provided.

Tabs 40, 41 are provided at the free ends of the sections 12 and 13. The tab 41 at the end of the section 13 has an elongated opening 42 with which the package can be pushed onto a hook of a sales stand. The opening 42 bulges out somewhat in the centre, in order that it can snap round a knob 43 at the tab 40 of the other section 13. The opening 42 and the knob 43 form a pressure closure.

FIGS. 4, 5 and 6 show the package in the closed state. The package is folded together around the first fold axis 11, i.e. the two film hinges 14, with the result that the two sections 12 and 13 come to lie on each other. A closure is formed by projecting noses 44 at the end of the section 13 which engage in cut-outs 45 at the tab 40. FIGS. 4 to 6 show the storage or transportation form of the package, in which the small parts seated in the receptacles 27 are securely held fast and cannot fall out.

FIGS. 7, 8 and 9 show the form of the package for the removal of the individual small parts. The sub-sections 19 to 22 are folded back around the film hinges, with the result that the backs of these sub-sections 19 to 22 now face each other. The receptacles 27, hitherto aligning with each other and opening themselves to each other, of the opposite rows 23 and 24 and 25 and 26 respectively are now directed in parallel and open upwards. Because of the intermediate strip 18 the small parts of the individual rows are at an adequate distance, with the result that they can be removed without difficulties. To fix the package in this form, the noses 44 at the lateral end of the section 13 are inserted into slits 47 in the tab 41. Corresponding noses 44 are also moulded on at the lateral end of the section 12, which are pressable into slits 47 engaging with them in the tab 40. As is recognizable in FIG. 7 in particular, the tabs thereby simultaneously form broad standing feet for the placement of the package on a work bench, the longitudinal axes of the small parts then standing vertically.

In order to keep the sub-sections 19 and 20 and 21 and 22 respectively parallel to each other in the service form, the film hinges 17 can also be so designed according to FIG. 10 that, when the sub-sections 19 to 22 are folded down, a dead-centre position is passed through, with the result that the film hinges 17 are in each case stable in the flat form shown in FIGS. 1 to 3 and in the rectangular position relative to the intermediate strip 18 according to FIGS. 7 to 9. This is achieved through moulded-in springs 49, which are shown in FIG. 10. In the area of these springs 48, the film hinges 17 are interrupted and replaced by the springs 48. The springs 48 are articulated by short film hinges 49, which in each case lie at roughly the same distance on both sides of the axis of the film hinges 17, to the strip 18 and to one of the sub-sections 19 to 22. While the film hinges 17 lie in the plane of the back of the support 10, the short film hinges 49 of the springs 48 lie in the plane of the front of the support 10, with the result that they are offset by the material thickness of the support 10. This offset results in two stable positions for the sub-sections 19 to 22, which are drawn in in FIG. 10 with a solid line and with a broken line (service form).

To prevent small parts from being removed without authority, a security strip 50 can be stretched over the package in the sales form according to FIG. 1. The two ends of the security strip 50 are glued or welded fast on the surface of two opposite receptacles 27. Only after the security strip 50 has been cut through can the sub-sections 19 to 22 be folded back (service form according to FIGS. 7 to 9), with the result that small parts can then be removed.

FIG. 11 shows a view similar to that of FIG. 2, except that the receptacles 27 are designed as open clips. The small parts can therefore be removed not only when the sub-sections 19 to 22 are folded over according to FIGS. 7 to 9, but also in the use form according to FIGS. 1 to 3, in which the areal support 10 is flat.

FIG. 12 shows a view similar to that of FIG. 1, except, as in the version of FIG. 11 the receptacles 27 are designed as open clips. It is noted that two part of opposed open clips are used to retain each part. Small parts, for example, parts 29 and 30 shown in phantom, can be placed opposite one another, such as part 29 in subsection 21 of section 13 and part 30 in subsection 22 of section 13. Receptacles for parts having "large" heads can be provided by extending the receptacle away from the inside surface of the package. This is shown in FIG. 11 and in FIG. 12 with the nut driver insert 31 in subsection 20 of section 12. In FIG. 12, all but one of the receptacles 27 in subsection 20 of section 12 are designed for the larger headed nut drivers. Therefore, opposed subsection 19 of section 12, only retains one screwfinder in its two pairs of cooperating open clips 27. Depending on the items to be packaged, various receptacle 27 arrangements can be provided.

The foregoing detailed description is given primarily for clearness of understanding and no unnecessary limitations are to be understood therefrom for modifications can be made by those skilled in the art upon reading this disclosure and may be made without departing from the spirit of the invention and scope of the appended claims.

We claim:

1. Package for small parts with an areal longitudinal support (10) which has a front and a back, and with receptables (27) for the small parts, characterized in that the support (10) is divided by a first fold axis (11) into two sections (2, 13) and is foldable around the first fold axis (11) in such a way that the two sections (12, 13) face each other with their fronts, in that the support (10) has a second fold axis (16) which runs at a right angle to the first fold axis (11) and divides the two sections (12, 13) each into two subsections (19, 20 and 21, 22 recpectively), the support (10) being foldable around the second fold axis (16) in such a way that the backs of the sub-sections (19 to 22) face each other, and the receptables (27) are designed as pockets which are so arranged at the edge of the sub-sections (19 to 22) that the openings (28) of the pockets (27) at one longitudinal edge face the openings (28) of the pockets (27) at an opposite longitudinal edge.

2. Package according to claim 1, characterized in that the package is in one piece, the fold axes (11, 16) being designed as integral hinges (14, 17 respectively).

3. Package according to claim 2, characterized in that the first fold axis (11) is formed by two integral hinges (14, 14) running substantially parallel at a distance, the distance between these integral hinges (14, 14) being equal to a height dimension of the package if the package is folded together around the first fold axis (11).

4. Package according to claim 3, characterized in that the second fold axis (16) is formed by two integral hinges (17, 17) running substantially parallel at a distance from one another.

5. Package according to claim 4, characterized in that the distance between the film hinges (17, 17) lies in the range from roughly a sixth to roughly a third of the width dimension of the support (10).

6. Package according to one of claims 1 to 5, characterized in that the receptacles (27) are designed as pockets which are so arranged at the edge of the sub-sections (19 to 22) that the openings (28) of the pockets (27) at one longitudinal edge face the openings (28) of the pockets (27) at the opposite longitudinal edge.

7. Package according to claim 1, characterized in that the pockets (27) at the longitudinal edge of one sub-section (19 to 22) are designed as a removable separate element.

8. Package according to claim 1, characterized in that the pockets (27) at the longitudinal edge of one sub-section (19 to 22) have means for locking in the folded-over position.

9. Package according to claim 2 in combination with small parts (29, 30) contained in the pockets (27), characterized in that pockets (27) lying opposite each other are so matched in their depth and in their distance from each other relative to the longitudinal dimensions of the small parts (29, 30) accommodated in them so that exposed portions of the small parts (29,30) are sufficiently small so that the small parts (29,30) are retained in the pockets.

10. Package according to claim 9, characterized by a device (50) for the blocking of the second fold axis (11).

11. Package according to one of claims 1 to 5, characterized in that each of the receptacles (27) is designed as two pairs of cooperating open clips.

12. Package according to claim 2, characterized in that the second fold axis (16) is formed by two integral hinges (17, 17) running substantially parallel at a distance from one another.

13. Package according to claim 12, characterized in that the distance between the integral hinges (17,17) lies in the range from roughly a sixth to a third of a width dimension of the support (10).

14. Package according to one of claim 1, characterized in that the second fold axis (16) is formed by two integral hinges (17, 17) running substantially parallel at a distance from one another.

15. Package according to claim 14, characterized in that the distance between the integral hinges (17,17) lies in the range from roughly a sixth to a third of a width dimension of the support (10).

16. Package according to claim 1 in combination with small parts (29, 20) contained in the pockets (27) characterized in that pockets (27) lying opposite each other are so matched in their depth and in their distance from each other relative to the longitudinal dimensions of the small parts (29, 30) accommodated in the so that exposed portions of the small parts (29,30) are substantially small so that the small parts (29,30) are retained in the pockets.

17. A package for small parts, said package being capable of being arranged in any one of three functional positions, namely:

i. a first shipping and storage position where said parts are substantially fully enclosed within the package;

ii. a second display position where the package displays the parts for view, but retains the parts so that the parts are not readily able to be removed from the package;

iii. a third service position where the parts are visible and disposed so as to be able to be readily removed and replaced from the package;

said package comprising:

a. an areal support member which has a bottom surface and a top surface, which has a transverse axis and a longitudinal center axis and which comprises:

i. right and left support portions which are joined together at adjacent transverse edge portions by a transversely extending hinge portion;

ii. right and lower support portions which are joined together at adjacent longitudinal edge portions joined together by a longitudinal hinge portion;

iii. said transversely extending hinge portion and said longitudinal hinge portion dividing said support member into four support sections, said support sections comprising an upper right support section; a lower right support section; a lower left support section; and an upper left support section;

b. each of said sections having a plurality of longitudinally spaced receptacle means, each of which has a transversely aligned recess to receive a related part, each recess having an end opening adjacent to and facing said longitudinal center axis to receive said related part, in a manner that the receptacle means of the upper left and lower left sections are facing one another when the upper left and lower left sections are in the second display position, and the receptacle means of the upper right and lower right sections are facing one another when the upper right and lower right sections are in the display positions;

c. said package being arranged so that:

i. in the first shipping and storage position, the right and left support portions are folded about the transversely extending hinge portion so as to overlie one another so as to enclose the receptacles with the parts therein, and with bottom surfaces of the right and left support portions being positioned as outside surfaces;

ii. in said second display position, the upper right section, lower right section, lower left section and upper left section are all in substantial co-planar relationship, so that the receptacle openings of the upper and lower right sections face each other, and the receptacle openings of the upper and lower left sections are facing one another;

iii. in the third service position, the upper and lower support portions are folded toward one another about the longitudinal hinge portion in a manner that the upper and lower support portions extend downwardly from said longitudinal hinge portion, the front surfaces of the upper and lower portions are exposed and face outwardly away from one another, and the openings of the receptacle means face upwardly in a substantially unobstructed position;

d. the receptacle means having the recesses thereof sized with sufficient longitudinal depth, and having the recess openings of facing receptacle means spaced sufficiently close to one another so that with the package in the second display position, parts positioned in said receptacle means are substantially obstructed from removal from said receptacle means;

e. said receptacle means being positioned and arranged so that with the package in the third service position, the end openings of the receptacle means are out of opposed facing relationship in a manner that the parts in the receptacle means can be removed without encountering any substantial obstruction, whereby the package can be used to contain the parts for shipment and storage, the package can be moved to the second position to display the parts as a sales display without having the parts removed or stolen from the package, and the package can be used as a services package where parts can readily and conveniently be removed from and inserted into receptacle means of the package.

18. The package as recited in claim 17, characterized in that each receptacle means is designed as a pocket member.

19. The package as recited in claim 17, wherein there is releasable connecting means engaging the upper and lower support portions to retain the upper and lower support portions in the third position.

20. The package as recited in claim 17, wherein the longitudinal hinge portion interconnecting the upper and lower portions comprises a longitudinally extending connecting portion having two longitudinally spaced hinge connections, whereby the package in the third service position has the upper and lower support portions spaced laterally from one another to provide increased stability when the package is placed on a support surface.

21. The package as recited in claim 17, wherein said parts are in combination with at least one large part positioned in oppositely facing receptacle means, with said parts having portions positioned adjacent to said longitudinal axis located to obstruct a part in a position of the opposing relationship from removed from its related receptacle means.

22. The packaged as recited in claim 17, wherein with the package in the second display position, said relatively larger part is positioned in a receptacle in one of the upper lower support portions which extends across the longitudinal center line and is obstructed from longitudinal movement out of its related receptacle means by the other of the upper and lower support portions, whereby with the package in the second display position, the relatively larger part cannot readily be removed from the package.

* * * * *